United States Patent [19]

Babington et al.

[11] Patent Number: 4,507,074

[45] Date of Patent: Mar. 26, 1985

[54] FLOW CONTROL MODULE AND METHOD FOR LIQUID FUEL BURNERS AND LIQUID ATOMIZERS

[75] Inventors: Robert L. Babington; Robert S. Babington, both of McLean, Va.

[73] Assignee: Owens-Illinois, Inc., Toledo, Ohio

[21] Appl. No.: 476,292

[22] Filed: Mar. 17, 1983

[51] Int. Cl.[3] ..... F23H 1/00

[52] U.S. Cl. ..... 431/12; 431/117; 239/75; 239/124; 239/434

[58] Field of Search ..... 431/12, 117, 118, 175, 431/285, 89; 60/734; 239/75, 433, 434, 427.3, 427.5, 124, 126; 236/93 R

[56] References Cited

U.S. PATENT DOCUMENTS

| | | | |
|---|---|---|---|
| 2,454,141 | 11/1948 | Drapeau | 236/93 R |
| 2,599,699 | 6/1952 | Dilworth et al. | 239/75 |
| 2,859,806 | 11/1958 | Lake et al. | 239/75 |
| 2,896,862 | 7/1959 | Bede | 239/124 |
| 3,126,942 | 3/1964 | Tyler | 239/75 |
| 3,425,058 | 1/1969 | Babington | 431/117 |
| 3,972,351 | 8/1976 | Schuitemaker et al. | 431/12 |

*Primary Examiner*—Samuel Scott
*Assistant Examiner*—Noah Kamen
*Attorney, Agent, or Firm*—Pollock, Vande Sande & Priddy

[57] ABSTRACT

An improved apparatus is disclosed for controlling the flow of liquid fuel through a feed tube onto the convex exterior surface of an atomizer bulb of the Babington type. Liquid fuel is directed through an inlet conduit (44, 46) into a deaeration chamber (50) having a suitable baffle for separating entrained air and dissipating dynamic flow effects. The inlet (64) of the feed tube for the atomizer bulb is positioned at the lower end (54) of the deaeration chamber so that as the chamber fills with liquid fuel, any air in the feed tube is quickly flushed. Between the inlet conduit (44,46) and the inlet (64) to the feed tube, a filter plug (71) dampens flow pulsations in the liquid passing into the inlet (64). The upper end of the deaeration chamber is closed and provided with an inlet (56, 104) to a suction conduit (58). An adjustment (62,72–881; 90–126) is provided to permit variation of the flow through the suction conduit and, hence, variation of the flow over the atomization bulb. To provide a constant flow rate of atomized fuel leaving the aperture even as the temperature of the fuel varies, a temperature sensitive valve (66; 128–138) may be provided at the outlet of the pump with a suitable bypass (68) to the sump or in the suction conduit (70) or in both locations. Methods of delivering liquid fuel are disclosed.

37 Claims, 3 Drawing Figures

FIG. 1
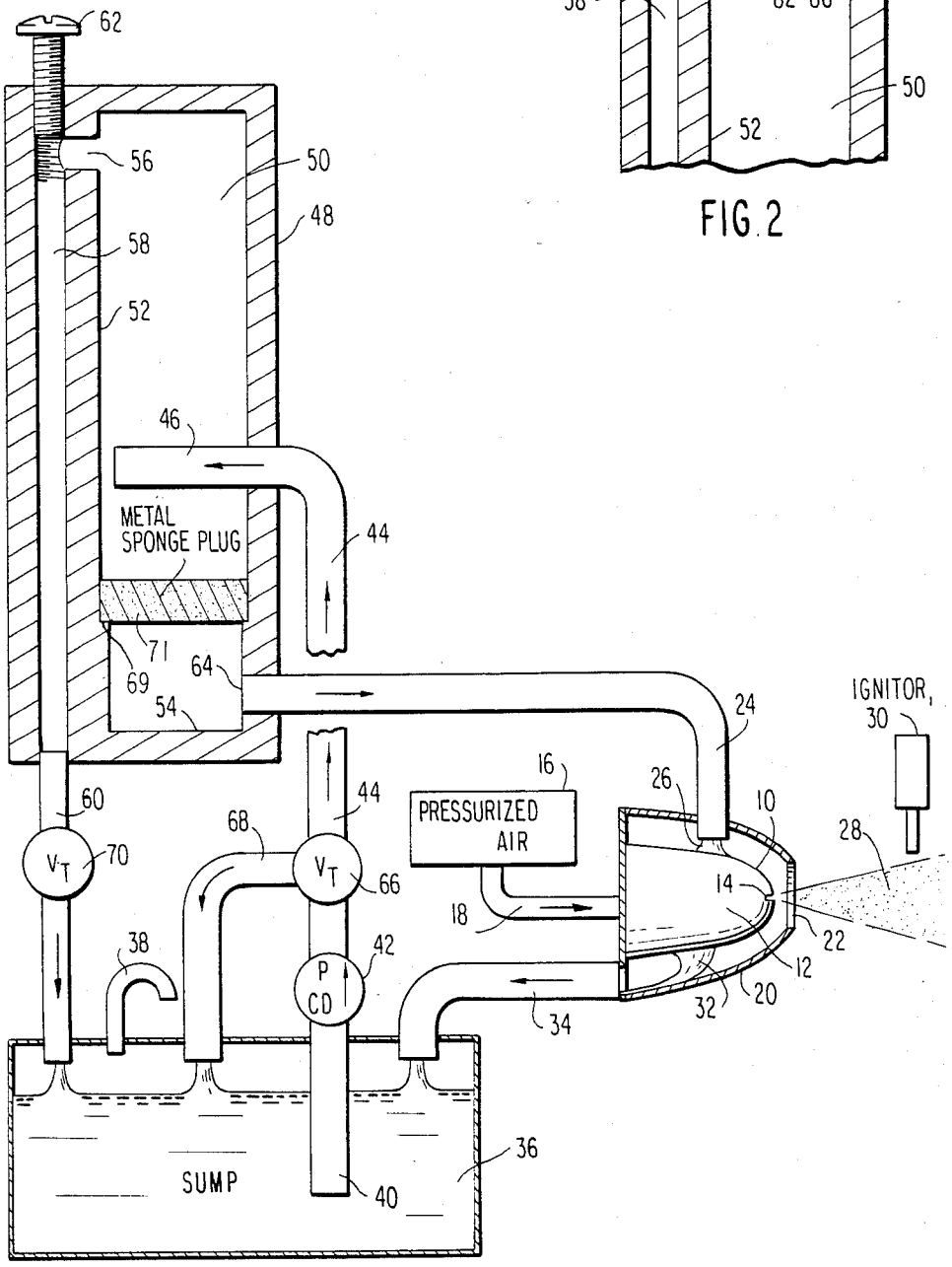
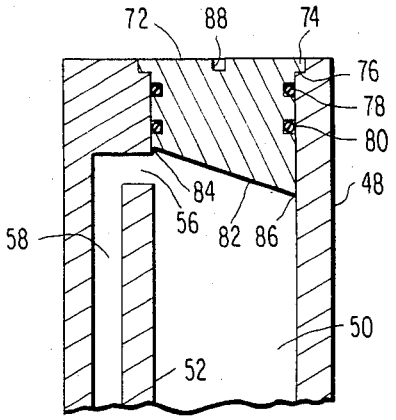
FIG. 2

FLOW CONTROL MODULE AND METHOD FOR LIQUID FUEL BURNERS AND LIQUID ATOMIZERS

DESCRIPTION

1. Cross-Reference to Related Applications

The present application is related to three other applications filed concurrently and entitled Improved Liquid Delivery Apparatus for Liquid Fuel Burners and Liquid Atomizers, Ser. No. 476,453; Improved Atomization Apparatus and Method for Liquid Fuel Burners and Liquid Atomizers, Ser. No. 476,454; and also Flow Control Module and Method for Liquid Fuel Burners and Liquid Atomizers, Ser. No. 476,455.

2. Technical Field

The present invention concerns liquid fuel burners and liquid atomizers and methods of operating such burners and atomizers. The apparatus and method of the invention are particularly related to liquid fuel flow control systems and methods for burners and atomizers of the type which incorporate an atomizer bulb having a smooth, convex exterior surface tapering toward an aperture. A flow of air or other gas is directed through the aperture to atomize the fuel or other liquid as it flows in a thin film over the exterior surface of the atomizer bulb.

3. Background Art

In January 1969, U.S. Pat. Nos. 3,421,692; 3,421,699 and 3,425,058 issued to Robert S. Babington and his co-inventors. These patents disclose a type of liquid atomization apparatus which is particularly useful in liquid fuel burners. The principle involved in the apparatus, now frequently referred to as the "Babington principle," is that of preparing a liquid for atomization by causing it to spread out in a free-flowing thin film over the exterior surface of a plenum having an exterior wall which defines the atomizer bulb and contains at least one aperture. When gas is introduced into the plenum, it escapes through the aperture and thereby creates a very uniform spray of small liquid particles. By varying the number of apertures, the configuration of the apertures, the shape and characteristics of the surface, the velocity and the amount of liquid applied to the surface, and by controlling the gas pressure within the plenum, the quantity and quality of the resultant spray can be adjusted as desired to suit a particular burner application. Various arrangements of such atomization apparatus have been disclosed in other U.S. patents issued to the present applicant, namely U.S. Pat. Nos. 3,751,210; 3,864,326; 4,155,700; and 4,298,338. The disclosures of the patents mentioned in this paragraph are specifically incorporated by reference into this application.

So that liquid fuel burners and liquid atomizers constructed in accordance with the Babington principle will have the widest possible range of applications, it has been found desirable to provide the maximum possible variation in the volumetric flow rate of the atomized fuel or other liquid between the lowest and the highest flow rates required. For example, flow rates as low as 0.3785 liter (0.1 gallon) per hour may be required for some applications and as high as 3.785 liters (1.0 gallon) per hour may be required for others.

Once the particular geometry for a given atomization apparatus has been selected, however, changes in the flow rate of the atomized liquid must be made primarily by adjusting the flow rate of liquid onto the atomizer bulb. For the lowest flow rate desired, the liquid film thickness at the aperture preferably would be the thinnest achievable while still maintaining a continuous film over the exterior surface of the atomizer bulb. On the other hand, to provide higher flow rates of the atomized liquid, it is necessary to increase the thickness of the film at the aperture without increasing it so much that undesirably large liquid particles are formed. In prior art apparatuses, a single liquid feed tube has been positioned above each atomizer bulb so that a variable flow rate of atomized liquid from about 0.757 to 2.27 liters (0.2 to 0.6 gallons) per hour has been achievable.

While this type of prior art apparatus has been demonstrated to be a very efficient means for providing a spray of fuel for applications such as oil burners , erratic behavior occasionally has been observed during startup and particularly when the flow of liquid fuel over the atomizer bulb and the pressurized gas through the aperture are started simultaneously. Occasionally, an apparatus which had been functioning as desired for some time and then shut down for a period has been found to produce a stuttering, spluttering spray when fuel and air flow are started again after even a brief shutdown.

Continued research has shown that this erratic behavior can be due to the presence of air which becomes trapped in the feed tube to the atomizer bulb during shutdown, or to air entrained or dissolved in the fuel leaving the fuel pump, or to some combination of the two. Instability during startup can also be the result of surface tension and viscosity effects as the surface of the atomizer bulb is wetted during each startup procedure. As a result of such conditions, the flow of fuel leaving the feed tube may be somewhat irregular for a transient period during startup. During this transient period the surface of the atomizer bulb may not become completely covered with a thin film of fuel for as long as two or three seconds after the flows of fuel and air commence. During this time the quality of the spray of fuel is rather poor which can lead to difficulties in starting conditions, carry-over of raw fuel into the flame tube and other undesirable effects.

In some liquid fuel burners embodying the Babington principle, the flow rate of atomized fuel has been found to decrease somewhat as the temperature of the fuel increases during operation, apparently due to increased leakage in the pump and perhaps to changes in fuel properties as a function of temperature. In certain applications, however, it is considered desirable that the flow rate of atomized fuel leaving the aperture of the atomizer bulb should remain relatively constant as the temperature of the fuel varies, a mode of operation which has been difficult to produce with prior art burners.

DISCLOSURE OF THE INVENTION

The primary object of the present invention is to provide a liquid fuel flow control module and method for use with fuel burners embodying the Babington principle, which not only removes entrained air from the fuel flowing to the atomizer bulb, but also rapidly and reliably flushes air from the fuel feed tube when operation of the burner commences.

Another object of the invention is to provide such a flow control module and method in which the pressure at the inlet to the feed tube is maintained essentially constant so that the flow rate of atomized fuel remains essentially constant regardless of variations in fuel temperature.

Still another object of the invention is to provide such a flow control module and method which will produce an initial flush of liquid to completely wet the surface of the atomizer bulb, followed by an automatic reduction in the flow of liquid to a level required to establish the desired film thickness for the minimum atomization rate, all within a few seconds before atomizing air is introduced into the atomizer bulb.

Yet another object of the present invention is to provide such a flow control module and method which permit a wider range of adjustments to the rate of flow of fuel to the atomizer bulb than has been achievable with prior art systems.

A further object of the invention is to provide such a module and method which facilitate accurate control of the liquid atomization rate, yet use large passageways not appreciably affected by gas bubbles, dirt and viscosity changes to the extent of conventional flow controllers such as needle valves.

A further object of the present invention is to provide such a fuel flow control module and method which will reliably re-establish a desired flow rate of fuel to the atomizer bulb following periods of shut-down.

A still further object of the invention is to dampen out liquid flow pulsations so that a smooth, essentially laminar flow of liquid is delivered to the atomizer bulb.

These objects of the invention are given only by way of example. Thus, other desirable objectives and advantages inherently achieved by the disclosed apparatus and method may occur or become apparent to those skilled in the art. Nonetheless, the scope of the invention is to be limited only by the appended claims.

In accordance with the invention, an apparatus for controlling the flow of liquid to a liquid atomization apparatus comprises a source of liquid, an enclosed volume positioned above the atomizer and means for delivering a first flow of liquid from the source into the enclosed volume. The flow into the enclosed volume is baffled to remove entrained gases into the liquid, so that the volume also serves as a deaeration chamber. Near the lower end of the enclosed volume, means are provided for withdrawing a second flow of liquid, not exceeding the magnitude of the first flow, from the volume and for feeding the second flow to an atomizer bulb. Between the means for withdrawing the second flow and the means for delivering the first flow, means are provided for damping flow pulsations in at least a portion of the first flow. Near the upper end of the enclosed volume, means are provided for applying suction to withdraw a third flow of liquid from the enclosed volume and, preferably, for returning the third flow to a reservoir or sump for recirculation.

In operation of such an apparatus in accordance with the method of the invention, liquid initially flows into the enclosed volume, which is assumed to have drained during a shutdown period through the means for feeding the second flow to the atomizer. This initial flow of liquid flushes air from the means for feeding liquid to the atomizer bulb. The flow rate to the atomizer bulb increases as the level of liquid in the enclosed volume rises to the level of the means for applying suction to withdraw a third flow, at which time the third flow commences and the second flow is reduced to the desired flow rate to the atomizer bulb. In a typical application, the desired flow rate is established in from two to four seconds from the start of fuel flow. In one preferred but not critical application of such a flow control module, it comprises a part of a purging system which establishes the desired flow of liquid before atomizing air is introduced into the atomizer bulb. In this manner all pulsations, irregularities, and air bubbles that may be associated with the fuel flow startup regime, have either settled out or disappeared before the compressed air is introduced to the atomizers. This promotes instantaneous ignition and assures that the firing rate remains constant from light-off to light-off.

To permit adjustment of the flow rate to the atomizer bulb, the means for applying suction to withdraw the third flow comprises a conduit extending from the enclosed volume, preferably back to the liquid recirculation system, and a valve in the conduit for varying the flow rate therethrough. To provide an essentially temperature insensitive constant flow rate of atomized liquid leaving the atomizer bulb, means are provided for maintaining an essentially constant inlet pressure at the means for feeding a second flow to the atomizer bulb. This maintaining means may comprise a temperature responsive valve for diverting a portion of the first flow of liquid back to the fuel sump and for decreasing the magnitude of the diverted portion as the temperature of the liquid increases. Alternatively, the means for maintaining may comprise a temperature responsive valve for progressively reducing the magnitude of the third flow of liquid as the temperature of the liquid increases.

This type of method and apparatus for controlling the flow of liquid to a liquid atomization apparatus is particularly useful with atomizer bulbs of the type including a plenum having an exterior surface over which the second flow is fed and an aperture in this surface through which air is passed to atomize liquid flowing over the aperture. In such applications, the sucking away of the third flow reduces the second flow of liquid smoothly to a magnitude at which the exterior surface of the plenum is covered by a thin film of liquid, the unatomized liquid in the second flow preferably being returned in a continuous stream to the liquid sump for recirculation. In fuel burners, the liquid would be a suitable liquid fuel and means would be provided for igniting the spray of atomized fuel.

BRIEF DESCRIPTION OF THE DRAWING

FIG. 1 shows a schematic elevation view, partially in section, of a liquid fuel burner system which incorporates a liquid flow control module according to the present invention.

FIG. 2 shows a fragmentary sectional view of the upper portion of an alternate form of the deaeration chamber 50 illustrated in FIG. 1.

BEST MODE FOR CARRYING OUT THE INVENTION

Figure 3:
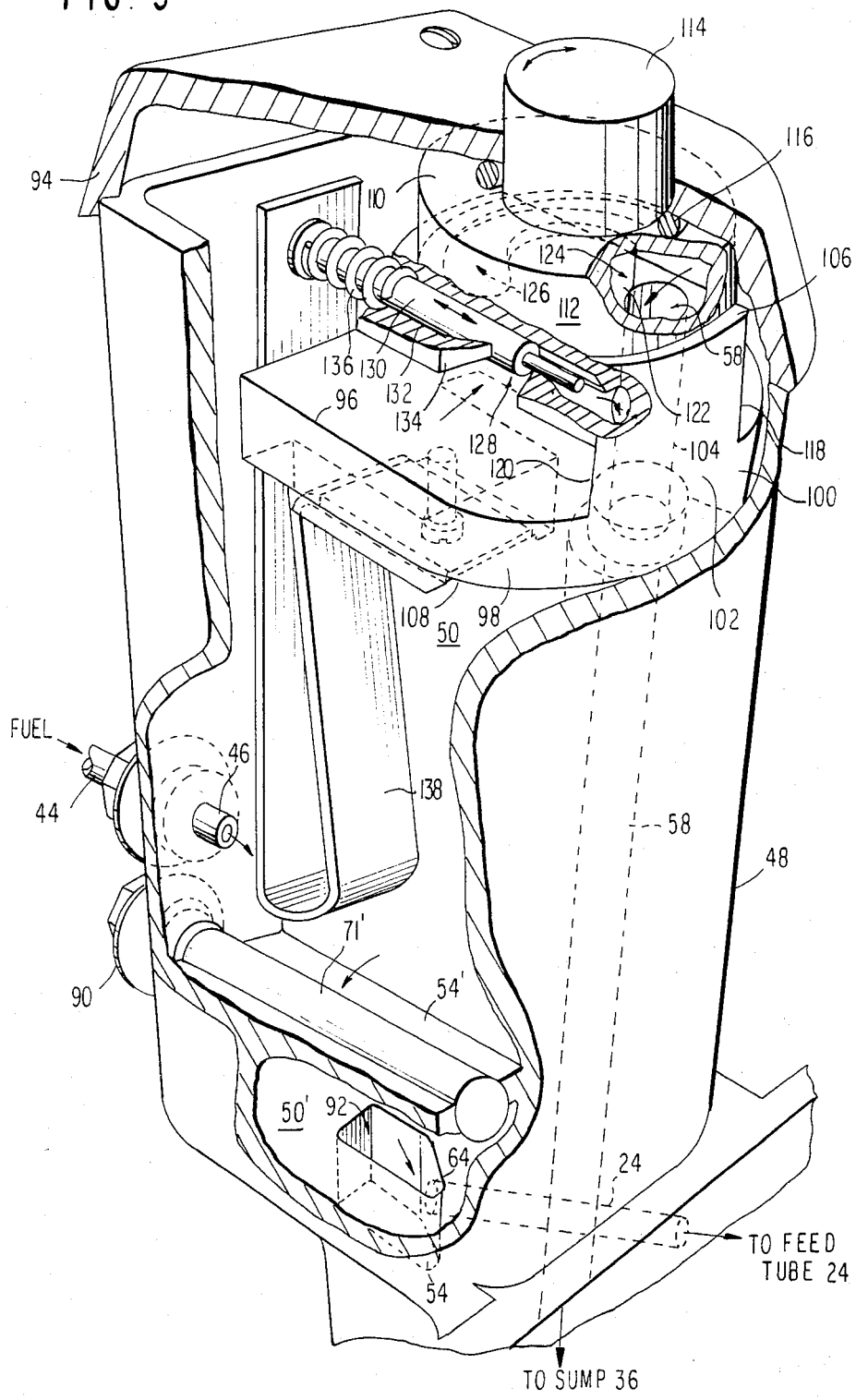
FIG. 3 shows a broken away perspective view of an actual embodiment of a liquid flow control module according to the invention.

The following is a detailed description of a preferred embodiment of the apparatus of the invention, reference being made to the drawing in which like reference numerals identify like elements of structure in each of the Figures.

A liquid fuel burner system embodying the present invention is shown in FIG. 1. A liquid atomizer bulb 10 having an inner plenum (not shown) defines an exterior wall 12 with a smooth, essentially convex exterior surface which tapers toward a frontal aperture 14. A source of pressurized air 16 directs a flow of air into the plenum via a conduit 18 so that air flows through aperture 14. A shield 20 surrounds bulb 10 to protect it from the ambient air flow and to produce other beneficial effects. Shield 20 is described in greater detail in the copending U.S. application entitled Improved Atomization Apparatus and Method for Liquid Fuel Burners and Liquid Atomizers. At the front of shield 20, an opening 22 is provided which is aligned with aperture 14. At the top side of shield 20, a fuel feed tube 24 extends through the wall of the shield to deliver a stream 26 of liquid fuel which covers the atomizer bulb with a thin, continuously flowing film. An effective arrangement of such a feed tube is disclosed in the copending U.S. application entitled Improved Liquid Delivery Apparatus and Method for Liquid Fuel Burners and Liquid Atomizers. Air passing through aperture 14 causes the formation of a spray of tiny droplets of liquid fuel which pass through opening 22 as a conical spray 28. An igniter 30 is used to ignite the spray. Any liquid fuel not atomized at aperture 14 flows from atomization bulb 10 as a stream 32 which leaves the interior of shield 20 via a conduit 34 which returns the unatomized fuel to a supply of fuel such as a sump 36.

A suitable vent 38 is provided for the sump, or the sump may be vented through conduit 34 if conduit 34 is not directly connected to shield 20 but is connected to an atomizing chamber (not illustrated), as would be done in most cases. This would allow vent 38 to be eliminated along with any undesirable fuel odor that might emanate from vent 38. An intake conduit 40 extends into the liquid and from sump 36 to a constant displacement pump 42. The outlet conduit 44 from pump 42 extends upwardly and eventually forms a horizontal inlet portion 46 which extends into a flow control module 48 according to the present invention.

Module 48 comprises an essentially cylindrical enclosed deaeration chamber or volume 50. Inlet portion 46 enters chamber 50 at approximately mid-height in the illustrated embodiment. However, the liquid inlet to chamber 50 can be placed higher or lower in the chamber without departing from the scope of the present invention so long as upward movement of separated gases is not prevented. The discharge end of inlet portion 46 preferably is positioned near the vertical wall 52 of chamber 50, or some other suitable baffle, so that liquid leaving portion 46 impinges on the wall as it flows into chamber 50. As a result of this impingement, most of the gases contained or entrained in the liquid are released and flow upwardly within chamber 50. Also, the dynamic pressure characteristics of the flowing liquid are dissipated considerably and do not affect flow in feed tube 24. The bottom wall 54 of chamber 50 preferably is positioned just below the location at which feed tube 24 extends into the chamber so that any sediment in the liquid will tend to settle in the bottom of chamber 50 rather than to flow onward through feed tube 24.

At the upper end of chamber 50, a horizontal passage 56 leads to a conduit 58 which extends downwardly until it leaves module 48 and joins a further conduit 60 which empties into sump 36 at a point below the discharge orifice of feed tube 24. At the upper end of conduit 58, a fuel flow adjustment screw 62 is provided, the position of which can be adjusted to open passage 56 completely, as illustrated, to close the passage completely or to any desired intermediate position, depending upon the desired flow rate through tube 24 to the atomizer bulb.

Assuming that the apparatus illustrated in FIG. 1 has been shut down for a period of time, any liquid in chamber 50 will have drained away through feed tube 24 and returned to sump 36 via conduit 34. When it is desired to produce a spray 28 of atomized liquid, liquid is pumped through conduit 44 and impinges against wall 52, thereby releasing its entrained gases which move upward within chamber and eventually are returned to sump 36 which is usually at or near atmospheric pressure. This would depend upon whether sump 36 was vented to atmosphere through vent 38 or vented back to the static pressure of an atomizing chamber, as previously discussed. Feed tube 24 is sized to have a minimum flow area somewhat smaller than that of conduit 46 and the volume of liquid entering chamber 50 is high enough so that the level of liquid in chamber 50 continues to rise toward passage 56 in spite of the fact that liquid is flowing out of conduit 24. As the level rises, the flow of liquid through feed tube 24 continues to increase, sweeping out any air that might be present in the feed tube.

When the level of liquid in chamber 50 reaches passage 56, the liquid flows into conduit 58. With adjustment screw 62 in its illustrated open position, a suction is applied at passage 56, resulting in a corresponding reduction in the pressure within chamber 50 and a subsequent reduction in the flow rate through feed tube 24. A smooth drop in flow through feed tube 24 is achieved, rather than a step change. By the time the change is complete, surface 12 is covered with a thin film of liquid and return stream 32 is thin but continuous. As will be discussed in greater detail subsequently, proper sizing of passage 56 and conduit 58 ensures that when passage 56 is wide open as illustrated, the falling liquid in conduit 58 will create a suction sufficient to draw away all of the flow from pump 42 except that portion required to establish the desired minimum flow rate onto atomizer bulb 10. The height of chamber 50 from the inlet to feed tube 24 to passage 56 is chosen so that there will be enough static head to provide the desired minimum flow rate, when the falling liquid in conduit 58 is creating a suction in passage 56.

Now, if adjustment screw 62 is driven inward so that passage 56 is progressively restricted, the flow through conduit 58 will gradually be reduced. Eventually, suction will no longer occur, but passage 56 and conduit 58 will continue to function as a simple bypass conduit to sump 36. As passage 56 is closed, the flow of liquid through feed tube 24 increases, eventually reaching a maximum when passage 56 has closed completely and chamber 50 is pressurized by pump 42. The type of flow control module just described has a distinct advantage over conventional flow control systems in which low flow is established by restricting a flow passage. In the present invention, the lowest rate of flow to atomizer bulb 20 is achieved without restricting any passageways, which makes clogging at low flows a virtual impossibility.

In one actual embodiment of the flow control module 48, the performance just described has been achieved with a pump 42 having a rated capacity of about 41.64 liters (eleven gallons) per hour, a discharge conduit 44, 46 having an inside diameter of about 3.18 mm (0.125 inch), a deaeration chamber having a height of about 88.9 mm (3.5 inches) and a diameter of about 25.4 mm (1.0 inch), a passage 56 and a conduit 58 having a diameter of about 4.76 mm (0.188 inch), and a feed tube having an interior diameter of about 2.36 mm (0.093 inch)

and a discharge opening located about 127 mm (5.0 inches) below passage 56. In such a system the volumetric flow rate of fuel in spray 28 can be adjusted smoothly from about 0.3785 liter (0.1 gallon) per hour to about 3.785 liters (1.0 gallon) per hour.

During operation of a liquid fuel burner system of the type illustrated in FIG. 1, the fuel temperature increases gradually as combustion continues, gradully rising, for example, from a starting temperature of approximately 65° F. to a steady operating temperature of approximately 120° F. As a result of this increase in temperature, many pumping systems exhibit a decrease in pumping efficiency. If such a pump 42 is used to deliver liquid fuel into chamber 50 via conduit 44, the gradual decay in flow through conduit 44 will result in a continually diminishing output through conduit 24. This in turn will cause the firing rate of the associated burner to decay. In many applications, such a decay in firing rate cannot be tolerated. The present invention makes allowances for pumps whose outputs decrease with increasing temperature.

The firing rate of a burner of the type shown in FIG. 1 remains essentially constant if the pressure at the inlet opening 64 of feed tube 24 is maintained essentially constant. When an essentially constant firing rate is desired, it can be achieved by providing in pump discharge conduit 44 a temperature sensitive valve 66 which diverts a portion of the flow from pump 42 back to sump 36 via a conduit 68, the magnitude of the diverted portion decreasing more or less linearly as the temperature of the liquid fuel increases. Alternatively, or in combination with valve 66 and conduit 68, the same result can be achieved by providing a temperature sensitive valve 70 in conduit 60. Thus the magnitude of the flow returning to sump 36 via conduits 58 and 60 can be reduced progressively as the temperature of the liquid fuel increases in operation. It should be clearly understood that valve 66, conduit 68 and valve 70 are purely optional in the present invention and need only be included in applications where the output of the pump decreases with temperature increases, and a relatively constant firing rate is desired. For such a purpose, any number of valves would be appropriate which contain a beam, strip, U-shape or coil bimetallic element of the type made by Hood and Co., Inc. of Harrisburg, Pa.

Just above the inlet opening 64 of feed tube 24, an annular ledge 69 supports a disc 71 of metal sponge, such as porous copper made by Astro Met Assoc. of Cincinnati and preferably having a porosity of about 40% to 60% dense and a thickness of about 3.18 mm (0.125 inch). Disc 71 functions primarily to dampen out undesirable pulsations in the flow of liquid through feed tube 24, which could be caused, for example, by a stuck piston in pump 24. In addition, by suitable selection of the porosity and thickness of disc 71, it can also function to restrict the flow of liquid to feed tube 24 at low temperatures, so that a more constant atomizing rate is achieved as the temperature of the liquid increases, even though the flow rate from pump 42 tends to decrease due to more internal pump leakage at higher temperatures. In many applications such as domestic oil burners, using disc 71 to minimize changes in atomizing rate with temperature may undesirably restrict the flow at lower temperatures when purging of feed tube 24 is necessary at startup. In such cases, disc 71 preferably is configured as previously indicated more or less as a coarse filter just to dampen out pulsations in a liquid flow. For this purpose, a substantial volume should be left between the underside of disc 71 and the inlet opening 64 of feed tube 24. Placing a filter plug of similar material in feed tube 24 has been found to provide little benefit, presumably because of the incompressible nature of a liquid.

The function of adjustment screw 62 can also be achieved with a plug valve 72 of the type illustrated in FIG. 2. The upper end of chamber 50 is provided with an open mouth. Valve 72 includes a radial flange 74 which seats on an annular surface 76 provided in the body of flow control module 48. Suitable means such as a circlip, not illustrated, prevent valve plug 72 from being ejected by the pressure of the liquid fuel during operation. A pair of axially spaced O-rings 78, 80 provide a seal against leakage of liquid fuel from chamber 50. The bottom surface 82 of plug valve 72 is cut at an angle so that its higher side 84 is at or somewhat above passage 56 and its lower side is below passage 56, as illustrated. A screw slot 88 is provided in the upper surface of valve plug 72 so that the plug can be rotated from its illustrated position in which passage 56 is wide open through 180° to a position in which passage 56 is completely closed.

FIG. 3 shows an actual embodiment of a flow control module 48 incorporating the invention shown schematically in FIG. 1. The interior of module 48 is divided into an upper chamber 50 and a lower chamber 50' by a bottom wall 54' of upper chamber 50. Wall 54' is drilled horizontally from the exterior of module 48 to receive a filter cylinder 71' of metal sponge of the type previously discussed. A threaded fitting or cap 90 holds filter cylinder 71' in place and facilitates its replacement should the filter become clogged. Fuel thus flows from portion 46 of conduit 44, through filter cylinder 71' and into lower chamber 50'. At the bottom of lower chamber 50', a small sump 92 is provided, which terminates at a bottom wall positioned below the location at which the feed tube 24 opens into chamber 50', for the purpose previously discussed.

The upper end of chamber 50 is closed by a cover 94. In this embodiment, the functions of flow adjustment screw 62 and temperature sensitive valves 66 and 70 are achieved by a single valve assembly 96 which drops into chamber 50 when cover 94 has been removed, but as illustrated is captured between cover 94 and an inwardly extending ledge (not illustrated) within chamber 50. Assembly 96 comprises lower, horizontally extending base flanges 98, 100 formed integrally with an upwardly extending valve seat and manifold block 102. An extension 104 of conduit 58 is drilled through from the upper surface 106 of block 102, to its lower surface 108, where extension 104 mates with conduit 58. A manually positionable valve member 110 is positioned between the underside of cover 94 and upper surface 106. Valve member 110 comprises a short cylindrical portion 112 from the upper surface of which extends an integral adjustment knob 114. An O-ring seal 116 surrounds knob 114 beneath cover 94 to prevent leakage from chamber 50 through the necessary clearance between the knob and cover.

As illustrated, the rearmost edge 118 of upper surface 106 of block 102 is positioned radially inwardly of the periphery of cylindrical portion 112; however, the forwardmost edge 120 of upper surface 106 preferably is positioned radially outwardly of the periphery of cylindrical portion 112. On the underside of cylindrical portion 112, a partial circumferential metering slot 122 (shown partially in phantom) is provided. Slot 122 tapers in the axial direction from a maximum depth at its maximum flow end 124, to a minimum depth at its minimum flow end 126. When valve member 110 is positioned as illustrated, fuel rising to the top of chamber 50 eventually flows up the backside of block 102, into the maximum flow end 124 of slot 102 where the slot extends past edge 118, and into extension 104 of conduit 58. When valve member 110 is rotated to position minimum flow end 126 above extension 104, the flow path is identical but more restricted, so that more fuel is forced to flow to conduit 24. Between these two positions, the flow can be adjusted in the manner previously discussed. When valve member is positioned with slot ends 124 and 126 on either side of extension 104, flow into extension 104 is prevented.

A temperature sensitive valve 128 is provided in block 102, in place of valves 66 or 70 of FIG. 1. A valve plunger 130 is slidably positioned in a horizontal bore 132 which opens at its right, interior end into extension 104. Approximately midway along the length of bore 132, block 102 includes a radial inlet 134 which connects bore 132 to chamber 50. At lower fuel temperatures, plunger 130 is biased to the left, as illustrated, by a spring 136; so that, parallel flows of fuel pass through slot 122 and through inlet 134 and bore 132, into extension 104. A U-shaped bimetallic element 138 is attached at its one end to lower surface 108, but at its other end presses against or is attached to plunger 130. As a result, increasing fuel temperatures cause element 138 to distort and move plunger 130 inward so that the plunger blocks inlet 134 and less fuel is returned to sump 36 via conduit 58. By controlling the flow through inlet 134 as a function of fuel temperature, an essentially constant firing rate can be achieved, as previously indicated.

INDUSTRIAL APPLICABILITY

While the present invention has been disclosed as particularly suited for use in liquid fuel burner systems, those skilled in the art will recognize that its teachings also may be followed for other applications of the Babington principle where it is desired to quickly and reliably establish a flow of liquid to the atomization bulb and to obtain a maximum variation in the flow rate of the vaporized liquid.

Having described our invention in sufficient detail to enable those skilled in the art to make and use it, we claim:

1. Apparatus for controlling the flow of liquid to a liquid atomizer, comprising:

a source of liquid;

an enclosed volume adapted to be positioned above the liquid atomizer;

first conduit means for delivering a first flow of liquid from said source into said enclosed volume at a position for enhancing separation of entrained gases from said liquid;

means, positioned in said enclosed volume below the point of entrance of said first flow, for damping flow pulsations in at least a portion of said first flow from said means for delivering;

second conduit means for receiving a second flow of liquid, not exceeding the magnitude of said first flow, from said enclosed volume at a location below said means for damping near the lower end of said enclosed volume and for feeding said second flow to the liquid atomizer, said second conduit means being open to ambient pressure at the location of the liquid atomizer for draining said enclosed volume through said second conduit means when said first flow ceases and for permitting the initial flow of liquid through said second conduit means to flush air therefrom, after which said second flow increases as said enclosed volume fills; and means for sucking a third flow of liquid from said enclosed volume at a location near the upper end thereof when the level of liquid in said enclosed volume reaches said means for sucking, at which time said third flow commences and reduces said second flow.

2. Apparatus according to claim 1, wherein said second conduit means is positioned above the bottom of said enclosed volume.

3. Apparatus according to claim 1, wherein said means for damping comprises a filter positioned between the point of entrance of said first flow and said second conduit means, whereby said enclosed volume is divided into upper and lower portions and flow pulsations are damped from said second flow.

4. Apparatus according to claim 1, wherein said means for sucking comprises a conduit extending from said enclosed volume and valve means for varying the flow through said conduit.

5. Apparatus according to claim 1, further comprising means for maintaining an essentially constant inlet pressure at said second conduit means.

6. Apparatus according to claim 5, wherein said means for maintaining comprises temperature responsive valve means for diverting a portion of said first flow of liquid, the magnitude of said portion decreasing as the temperature of said liquid increases.

7. Apparatus according to claim 5, wherein said means for maintaining comprises temperature responsive valve means for reducing the magnitude of said third flow of liquid away from said second conduit means, said magnitude being reduced progressively as the temperature of said liquid increases.

8. Apparatus according to claim 1, where said liquid atomizer is of the type including a plenum having an exterior surface over which said second flow is fed and an aperture in said surface through which air is passed to atomize liquid flowing over the aperture, and said second flow of liquid is reduced by said sucking to a magnitude at which the exterior surface of the plenum is covered by a thin film of liquid, the unatomized liquid in said second flow being withdrawn in a continuous stream.

9. Apparatus according to claim 8, further comprising means for maintaining an essentially constant flow rate of atomized liquid leaving said aperture.

10. Apparatus according to claim 9, wherein said means for maintaining comprises means for providing an essentially constant inlet pressure at said second conduit means.

11. Apparatus according to claim 10, wherein said means for maintaining comprises temperature responsive valve means for diverting a portion of said first flow of liquid away from said second conduit means, the magnitude of said portion decreasing as the temperature of said liquid increases.

12. Apparatus according to claim 10, wherein said means for maintaining comprises temperature responsive valve means for reducing the magnitude of said third flow of liquid, said magnitude being reduced progressively as the temperature of said liquid increases.

13. Apparatus according to claim 9, wherein said liquid is a liquid fuel and said atomizer is included in a fuel burner, further comprising means for igniting said atomized liquid.

14. Apparatus according to claim 1, wherein said first conduit means has a first, minimum flow area and said second conduit means has a second, smaller minimum flow area.

15. Apparatus for controlling the flow of liquid to a liquid atomizer, comprising:

a source of liquid;

an enclosed volume;

first conduit means for delivering a first flow of liquid from said source into said enclosed volume at a position for enhancing separation of entrained gases from said liquid;

means, positioned in said enclosed volume below the point of entrance of said first flow, for damping flow pulsations in at least a portion of said first flow from said means for delivering;

second conduit means for receiving a second flow of liquid, not exceeding the magnitude of said first flow, from said enclosed volume at a location below said means for damping near the lower end of said enclosed volume and for feeding said second flow to the liquid atomizer, said second conduit means being open to ambient pressure at the location of the liquid atomizer for draining said enclosed volume through said second conduit means when said first flow ceases and for permitting the initial flow of liquid through said second conduit means to flush air therefrom, after which said second flow increases as said enclosed volume fills;

third conduit means for withdrawing a third flow of liquid from said enclosed volume at a location near the upper end thereof when the level of liquid in said enclosed volume reaches said third conduit means for withdrawing, so that said second flow decreases.

16. Apparatus according to claim 15, wherein said second conduit means is positioned above the bottom of said enclosed volume.

17. Apparatus according to claim 15, wherein said means for damping comprises a filter positioned between the point of entrance of said first flow and said second conduit means, whereby said enclosed volume is divided into upper and lower portions and flow pulsations are damped from said second flow.

18. Apparatus according to claim 15, further comprising means for maintaining an essentially constant inlet pressure at said second conduit means.

19. Apparatus according to claim 18, wherein said means for maintaining comprises temperature responsive valve means for diverting a portion of said first flow of liquid away from said second conduit means, the magnitude of said portion decreasing as the temperature of said liquid increases.

20. Apparatus according to claim 18, wherein said means for maintaining comprises temperature responsive valve means for reducing the magnitude of said third flow of liquid, said magnitude being reduced progressively as the temperature of said liquid increases.

21. Apparatus according to claim 15, wherein said first conduit means has a first, minimum flow area and said second conduit means has a second, smaller minimum flow area.

22. A method for controlling the flow of liquid to a liquid atomizer, comprising the steps of:

providing a source of liquid;

providing an enclosed volume adapted to be positioned above the liquid atomizer;

delivering a first flow of liquid from said source through a first conduit into said enclosed volume at a position for enhancing separation of entrained gases from said liquid;

filtering at least a portion of said first flow within said enclosed volume to dampen flow pulsations;

withdrawing a second flow of liquid, not to exceed the magnitude of said first flow, from said enclosed volume following said filtering step, at a location near the lower end of said enclosed volume;

feeding said second flow to the liquid atomizer through a second conduit, said second conduit being open to ambient pressure at the location of the liquid atomizer for draining said enclosed volume through said second conduit when said first flow ceases and for permitting the initial flow of liquid through said second conduit to flush air therefrom, after which said second flow increases as said enclosed volume fills; and sucking a third flow of liquid from said enclosed volume at a location near the upper end thereof when the level of liquid in said enclosed volume reaches said location near said upper end, at which time said third flow commences and reduces said second flow.

23. A method according to claim 22, wherein said withdrawing occurs above the bottom of said enclosed volume.

24. A method according to claim 22, further comprising the step of maintaining an essentially constant inlet pressure for said second flow of liquid.

25. A method according to claim 24, wherein said maintaining is achieved by diverting a portion of said first flow of liquid away from said second flow, the magnitude of said portion decreasing as the temperature of said liquid increases.

26. A method according to claim 24, wherein said maintaining is achieved by reducing the magnitude of said third flow of liquid, said magnitude being reduced progressively as the temperature of said liquid increases.

27. A method according to claim 22, further comprising the steps of providing a liquid atomizer of the type including a plenum having an exterior surface over which said second flow is fed and an aperture in said surface through which air is passed to atomize liquid flowing over the aperture; and controlling said sucking so that said second flow is reduced by said sucking to a magnitude at which the exterior surface of the plenum is covered by a thin film of liquid, the unatomized liquid in said second flow being withdrawn in a continuous stream.

28. A method according to claim 27, further comprising the step of maintaining an essentially constant flow rate of atomized fuel leaving said aperture.

29. A method according to claim 28, wherein said maintaining is achieved by diverting a portion of said first flow of liquid, the magnitude of said portion decreasing as the temperature of said liquid increases.

30. A method according to claim 28, wherein said maintaining is achieved by reducing the magnitude of said third flow of liquid away from said second flow, said magnitude being reduced progressively as the temperature of said liquid increases.

31. A method according to claim 22, wherein said first conduit has a first minimum flow area and said second conduit has a second, smaller minimum flow area.

32. A method for controlling the flow of liquid to a liquid atomizer, comprising the steps of:

providing a source of liquid;

providing an enclosed volume;

delivering a first flow of liquid from said source through a first conduit into said enclosed volume at a position for enhancing separation of entrained gases from said liquid;

filtering at least a portion of said first flow within said enclosed volume to dampen flow pulsations; withdrawing a second flow of liquid, not exceeding the magnitude of said first flow, from said enclosed volume following said filtering step, at a location near the lower end of said enclosed volume;

feeding said second flow to a liquid atomizer through a second conduit, said second conduit being open to ambient pressure at the location of the liquid atomizer for draining said enclosed volume through said second conduit when said first flow ceases and for permitting the initial flow of liquid through said second conduit to flush air therefrom, after which said second flow increases as said enclosed volume fills; and withdrawing a third flow of liquid from said enclosed volume at a location near the upper end thereof when the level of liquid in said enclosed volume reaches said location near the said upper end, so that said second flow decreases.

33. A method according to claim 32, wherein said withdrawing a second flow occurs above the bottom of said enclosed volume.

34. A method according to claim 32, further comprising the step of maintaining an essentially constant inlet pressure for said second flow of liquid.

35. A method according to claim 34, wherein said maintaining is achieved by diverting a portion of said first flow of liquid away from said second flow, the magnitude of said portion decreasing as the temperature of said liquid increases.

36. A method according to claim 34, wherein said maintaining is achieved by reducing the magnitude of said third flow of liquid, said magnitude being reduced progressively as the temperature of said liquid increases.

37. A method according to claim 32, wherein said first conduit has a first minimum flow area and said second conduit has a second, smaller minimum flow area.

* * * * *